United States Patent [19]

Furukawa et al.

[11] Patent Number: 4,558,995

[45] Date of Patent: Dec. 17, 1985

[54] PUMP FOR SUPPLYING HEAD OF INK JET PRINTER WITH INK UNDER PRESSURE

[75] Inventors: Tatsuya Furukawa, Yokohama; Masanori Horike, Tokyo, both of Japan

[73] Assignee: Ricoh Company, Ltd., Tokyo, Japan

[21] Appl. No.: 603,068

[22] Filed: Apr. 23, 1984

[30] Foreign Application Priority Data

Apr. 25, 1983 [JP] Japan ..... 57-71508

[51] Int. Cl.[4] ..... F04B 43/04

[52] U.S. Cl. ..... 417/322; 417/413; 417/505

[58] Field of Search ..... 417/413, 322, 505

[56] References Cited

U.S. PATENT DOCUMENTS 3,840,758 10/1974 Zoltan ..... 417/322

4,344,743 8/1982 Bessman et al. ..... 417/322 X

FOREIGN PATENT DOCUMENTS 53-83102 7/1978 Japan ..... 417/322

*Primary Examiner*—Richard E. Gluck

*Attorney, Agent, or Firm*—David G. Alexander

[57] ABSTRACT

A pump furnished with an electrostrictive vibrator which pressurizes ink to be supplied to a head of an ink jet printer. The electrostrictive vibrator is adhered at one end to a diaphragm which closes an ink pressurization chamber, so that the vibrator vibrates integrally with the diaphragm perpendicularly to a plane in which it is adhered to the diaphragm, thereby varying the volume of the pressurization chamber. A vibrator drive signal supply circuit is installed in the pump which includes a time constant generation circuit adapted to apply a time constant to the waveform of a drive signal applied to the vibrator at the time of buildups and falls of the drive signal.

4 Claims, 9 Drawing Figures

PUMP FOR SUPPLYING HEAD OF INK JET PRINTER WITH INK UNDER PRESSURE

BACKGROUND OF THE INVENTION

The present invention relates to a device for pressurizing a liquid by means of an electrostrictive vibrator and, more particularly, to a pump furnished with an electrostrictive vibrator which is suitable for pressurizing a small volume of liquid such as ink to be supplied to a head of an ink jet printer.

A liquid pressurizing pump of the type described usually includes a pump housing, a suction valve and a delivery valve which are located respectively in a suction port and a delivery port formed in the pump housing, a liquid chamber communicating to the suction port and delivery port, and an electrostrictive vibrator adhered to part of the walls of the pump housing or the outer surface of a closure plate for closing the liquid chamber, which commonly constitutes a vibration plate. An AC voltage is applied to the electrostrictive vibrator to cause it into displacement so that the vibration plate integral with the vibrator is bent relative to the liquid chamber to vary the volume of the chamber. A liquid is sucked into the liquid chamber via the suction valve in response to the change of the volume of the chamber and the pressurized liquid is fed out via the delivery valve.

The liquid pressurizing pump constructed as described above is capable of causing the vibration plate to undergo a substantial bend in response to a relatively small displacement of the electrostrictive vibrator, thereby developing a substantial change in the volume of the liquid chamber. However, the problem with such a pump is that while the energy consumed for bending the vibration plate, i.e. the force acting in parallel to the vibration plate, is large, the energy for delivering the liquid, i.e. the force acting perpendicular to the vibration plate, is small, limiting the available pressure for the delivery of the liquid.

Meanwhile, the AC voltage applied to the vibrator of the prior art pump usually appears in a train of pulses and, for this reason, the vibration of the vibrator is sharp. Therefore, and particularly because the vacuum generated in the event of suction is strong, air bubbles tend to be formed in the liquid.

SUMMARY OF THE INVENTION

It is therefore an object of te present invention to provide an improved liquid pressurizing device for pressurizing a small volume of liquid by use of an electrostrictive vibrator.

It is another object of the present invention to provide a liquid pressurizing device furnished with an electrostrictive vibrator which is capable of increasing the delivery pressure of a liquid.

It is another object of the present invention to provide a liquid pressurizing device furnished with an electrostrictive vibrator which is capable of preventing air bubbles from being produced in a liquid by weakening vacuum developing at the time of suction.

It is another object of the present invention to provide a pump which is suitable for use with an ink jet printer to supply ink under pressure to a head of the printer.

It is another object of the present invention to provide a generally improved liquid pressurizing pump.

A pump for pressurizing a liquid to deliver the liquid of the present invention comprises a housing, a liquid chamber formed in the housing, a liquid suction passageway and a liquid delivery passageway which are formed in the housing, a suction valve and a delivery valve disposed respectively in the liquid suction passageway and the liquid delivery passageway, a flexible diaphragm for closing the liquid chamber, a lid member for cooperating with the diaphragm to define a space at a side opposite to the liquid chamber with respect to the diaphragm, and an electrostrictive vibrator disposed in the space and adhered at one end to the diaphragm and at the other end to an inner wall of the lid member, the electrostrictive vibrator vibrating integrally with the diaphragm perpendicular to a plane in which the electrostrictive vibrator is adhered to the diaphragm, thereby varying a volume of the liquid chamber.

The above and other objects, features and advantages of the present invention will become apparent from the following detailed description taken with the accompanying drawings.

DESCRIPTION OF THE PREFERRED EMBODIMENTS

Figure 1:
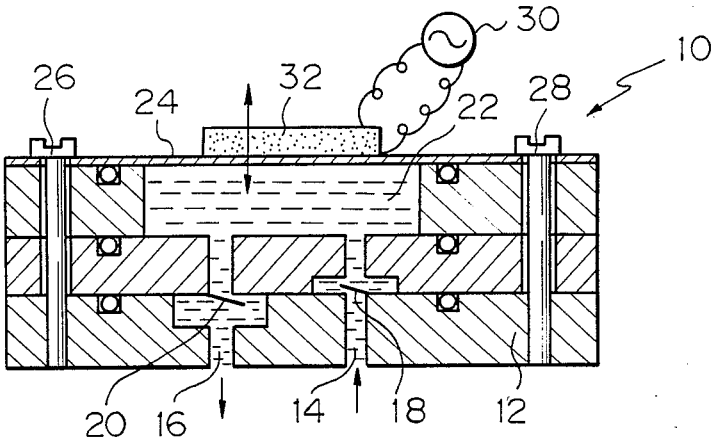
Fig. 1 PRIOR ART
FIG. 1 is a section of a prior art liquid pressurizing device of the type using an electrostrictive vibrator.

While the pump for supplying a head of an ink jet printer with ink under pressure of the present invention is susceptible of numerous physical embodiments, depending upon the environment and requirements of use, substantial numbers of the herein shown and described embodiments have been made, tested and used, and all have performed in an eminently satisfactory manner.

Before entering into detailed description of the present invention, a brief reference will be made to a prior art liquid pressurizing device, shown in FIG. 1. The device, generally 10, includes a housing 12 which is formed with a suction passageway 14 for sucking, for example, ink to be routed to a head of an ink jet printer, and a delivery passageway 16 for delivering the ink under pressure. A suction valve 18 is located in the suction passageway 14, and a delivery valve 20 in the delivery passageway 16. Both the suction and delivery passageways 14 and 16 merge into a pressurization chamber 22 which is formed in the housing 12. The pressurization chamber 22 is an ink pressurization chamber in this case. A thin closure member, or plate, 24 is disposed above the pressurization chamber 22 and fastened by bolts 26 and 28 to the housing 12 to close the chamber 22. In another type of prior art device, part of walls of the housing 12 is constructed to serve as the closure plate 24. An electrostrictive vibrator 32 is integrally mounted by adhesion on the outer surface of the closure plate 24 and caused to displace by an AC voltage which is applied thereto from an AC power surce 30.

In the above-described ink pressurizing pump 10, in response to the AC voltage from the AC power source 30, the electrostrictive vibrator 32 is caused to vibrate up and down as indicated by a double-headed arrow in the drawing. This in turn causes the closure plate 24 to vibrate integrally with the vibrator 32 to thereby vary the volume of the pressurization chamber 22. When the voltage is positive, the delivery valve 18 is opened to feed the ink under pressure out of the chamber 22 while, when it is negative, the ink is sucked into the chamber 22. Each of the valves 18 and 20 consists of a thin flat piece made of a resilient material such as stainless steel and, therefore, it normally closes its associated passageway 14 or 16 due to the resiliency.

In the prior art pump 10, the closure plate 24 is greatly deformable in response to a relatively small displacement, or vibration, of the vibrator 32 to in turn greatly change the volume of the pressurization chamber 22. However, the proportion of the energy consumed for bending the closure plate 24, i.e. the force acting on the closure plate 24 parallel thereto, is large and, therefore, the proportion of the energy available for delivering the ink, i.e. the force acting on the closure plate 24 perpendicular thereto, is small. This limits the pressure available for the delivery of the ink out of the pressurization chamber 22.

Hereinafter will be described preferred embodiments of the present invention which are free from the drawback discussed above, taking for example a pump installed in an ink jet printer for delivering ink under pressure to a head.

Figure 2:
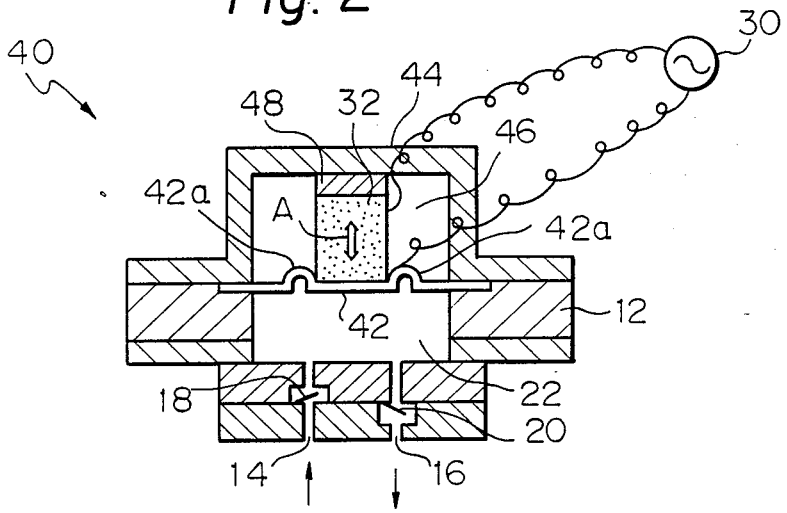
FIG. 2 is a section of a liquid pressurizing device furnished with an electrostrictive vibrator embodying the present invention.

Referring to FIG. 2, a pump in accordance with the first embodiment of the present invention is shown and generally designated by the reference numeral 40. In FIG. 2, the same or similar structural elements as those shown in FIG. 1 are designated by like reference numerals. As shown, the pump 40 includes a flexible diaphragm 42 having bends 42*a* which delimits the upper end of an ink pressurization chamber 22 at one surface thereof. At the other surface, the diaphragm 42 defines a space 46 in cooperation with a lid 44 which is made of a conductive material. Disposed in the space 46 is an electrostrictive vibrator 32 which is rigidly connected at one end to the diaphragm 42 and at the other end to an insulating member 48, which in turn is adhered to the inner wall of the lid 44. It will be noted that the insulating member 48 is omissible if the lid 44 is made of an insulating material. The vibrator 32 is shaped vertically long and polarized perpendicularly to an electrode.

In the above-described construction, although the displacement attainable with the vertically long vibrator 32 is somewhat smaller than that attainable with the vibrator 32 shown in FIG. 1, it deforms the diaphragm 42 by a same amount to vary the volume of the pressurization chamber 22 and is thereby directly reflected by an delivery pressure. Consequently, the pump in accordance with the first embodiment reduces the energy loss in the direction parallel to the general plane of the diaphragm 42 to thereby increase the ink delivery pressure, although slightly reducing the ink flow rate. Such a feature is desirable for an ink jet printer which requires a small flow rate on the order of 1 cc/min and a high pressure of 4–6 kg/cm$^2$.

Figure 3:
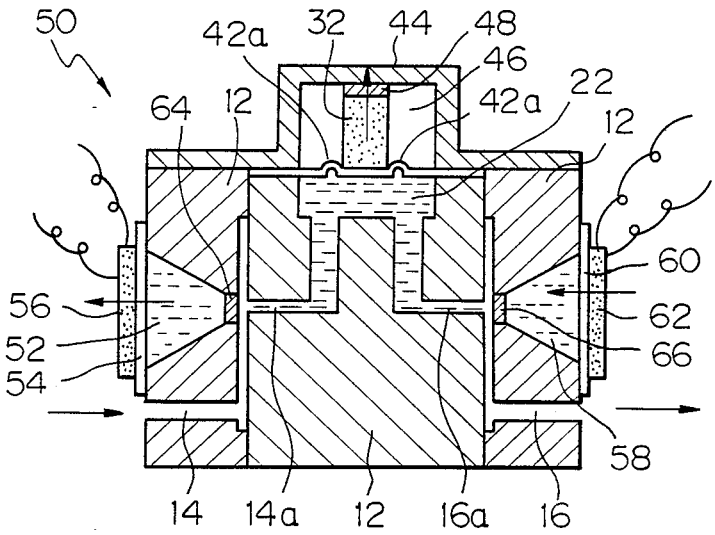
FIG. 3 is a section representative of another embodiment of the present invention.
Figure 4:
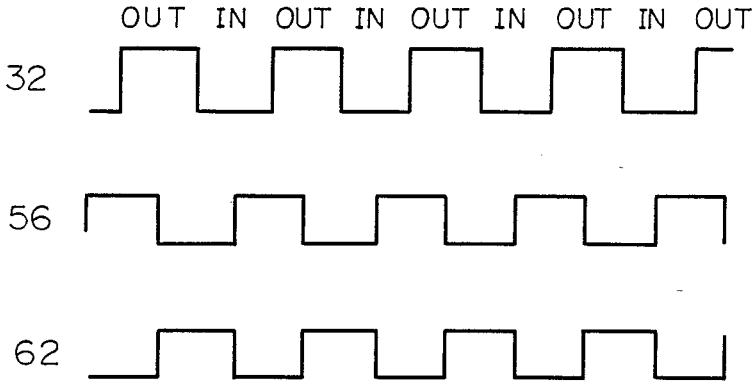
FIG. 4 is a timing chart demonstrating the operation of the device shown in FIG. 3.

Referring to FIGS. 3 and 4, another embodiment of the present invention is shown. In these drawings, the same or similar structural elements as those shown in FIGS. 1 and 2 are designated by like reference numerals. An ink pressurizing pump, generally 50, includes a hermetically closed conical chamber 52 which is formed in a wall of the housing 12 adjacent to the suction passageway 14. The chamber 52 is closed by a flexible diaphragm 54. An electrostrictive vibrator 56 for suction is integrally mounted on the outer surface of the diaphragm 54. Likewise, a hermetically closed conical chamber 58 is formed in a wall of the housing 12 adjacent to the delivery passageway 16 and closed by a flexible diaphragm 60. An electrostrictive vibrator 62 for delivery is integrally mounted on the outer surface of the diaphragm 62. Flexible members 64 and 66 are mounted respectively in the chambers 52 and 58 in positions remote from the diaphragms 54 and 60, that is, adjacent to the passageways. The flexible member 64 cooperates with the diaphragm 54 to hermetically close the chamber 52, while the flexible member 66 cooperates with the diaphragm 60 to hermetically close the chamber 58. The chambers 52 and 58 are individually filled with a liquid.

The flexible member 64 is located to face a passageway 14*a* which forms part of the suction passageway 14 and communicates to the pressurization chamber 22. Likewise, the flexible member 66 faces a passageway 16*a* which forms part of the suction passageway 16 and communicates to the pressurization chamber 22. In this construction, upon a displacement of the diaphragm 54 or 60 by several $\mu$m , for example, the flexible member 64 or 66 is displaced by an amplified amount which is larger than 0.1 mm, thereby stopping its associated 14*a* or 16*a*. In detail, when negative voltages are applied to the vibrator 32 above the pressurization chamber 22 and the suction vibrator 56 and a positive is applied the delivery vibrator 62 as shown in FIG. 4, the vibrators 32, 56 and 62 are individually shifted as indicated by arrows in FIG. 3 to unblock the passageway 14*a* and block the passageway 16*a*. This increases the volume of the pressurization chamber 22 so that the ink is sucked into the chamber 22. When a positive voltage is applied to the suction vibrator 56, a slightly negative voltage to the delivery vibrator 62, and a positive voltage to the vibrator 32, the vibrators 56, 62 and 32 are individually shifted in the opposite directions to the arrows to block the passageway 14*a* communicated with the pressurization chamber 22 and unblock the passageway 16*a*. As a result, the volume of the pressurization chamber 22 is reduced to deliver the ink out of the chamber 22.

In each of the first and second embodiments shown and described, the respective electrostrictive vibrators are applied with AC voltages from an AC power source, i.e. voltage pulses such as those shown in FIG. 4. It will be needless to mention that each of the embodiments is successful to reasonably achieve the objects of the present invention when such voltage pulses are employed to drive the respective vibrators. Nevertheless, they are not entirely free from the possibility of air bubbles developing in the ink because the displacements of the vibrators tend to be sharp to develop relatively intense vacuum at the time of suction.

Thus, the present invention purposes a unique drive signal generation device for supplying each of the electrostrictive vibrators with AC voltages.

Figure 5:
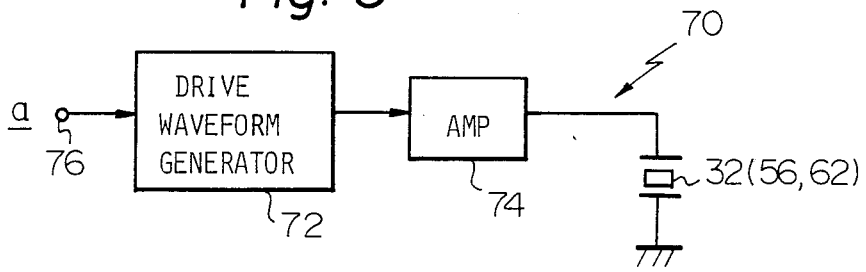
FIG. 5 is a diagram of a drive signal generation circuit for supplying drive signals to an electrostrictive vibrator of a device in accordance with the present invention.
Figure 6:
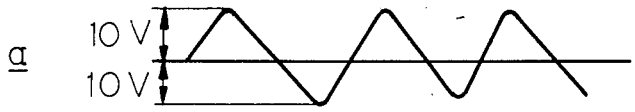
FIG. 6 is a waveform diagram representative of a signal supplied to the drive signal generator of FIG. 5.

Reference will be made to FIGS. 5-9 for describing in detail a drive signal indicator applicable to the electrostrictive vibrators included in the pump of the present inention. As shown in FIG. 5, the drive signal generator, generally 70, comprises a data signal waveform generation circuit 72 and an amplifier 74 for amplifying an output of the circuit 72. An AC signal such as a signal a shown in FIG. 6 is applied to an input terminal 76 of the data signal waveform generator 72. The signal a, unlike the pulse signal shown in FIG. 4 which sharply builds up and falls, is allowed to build up and fall with a time constant. Therefore, when signal a is amplified by the amplifier 74 to develop a drive voltage of ±200 V, for example, and the drive voltage is applied to the vibrators 32, 56 and 62, development of vacuum is prevented which would otherwise result from abrupt suction of the ink.

Figure 7:
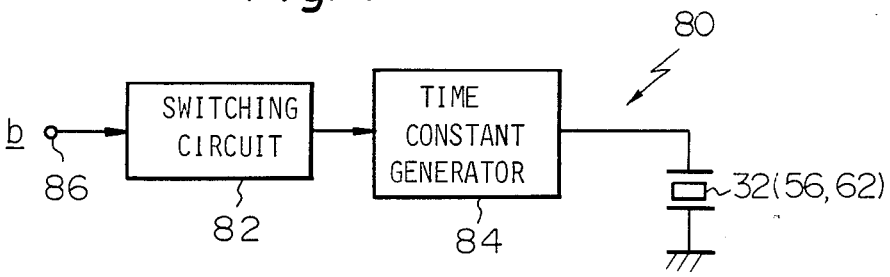
FIG. 7 is a diagram of another example of the drive signal generator.
Figure 8:
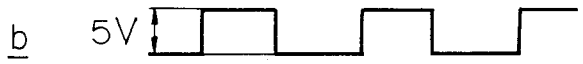
FIG. 8 is a waveform diagram representative of a signal supplied to the drive signal generator shown in FIG. 7.

Another example of the drive signal generator in accordance with the present invention is shown in FIG. 7. The drive signal generator 80 in this example comprises a switching circuit 82 and a time constant generation circuit 84. Applied to an input terminal 86 of the switching circuit 82 is a pulse signal such as a signal b shown in FIG. 8, which is a TTL level 5 V pulse signal. The time constant generator 84 gives a time constant to the pulse signal b to develop a drive voltage of, for example, ±200 V, which is then applied to the vibrator 32, 56 or 62.

Figure 9:
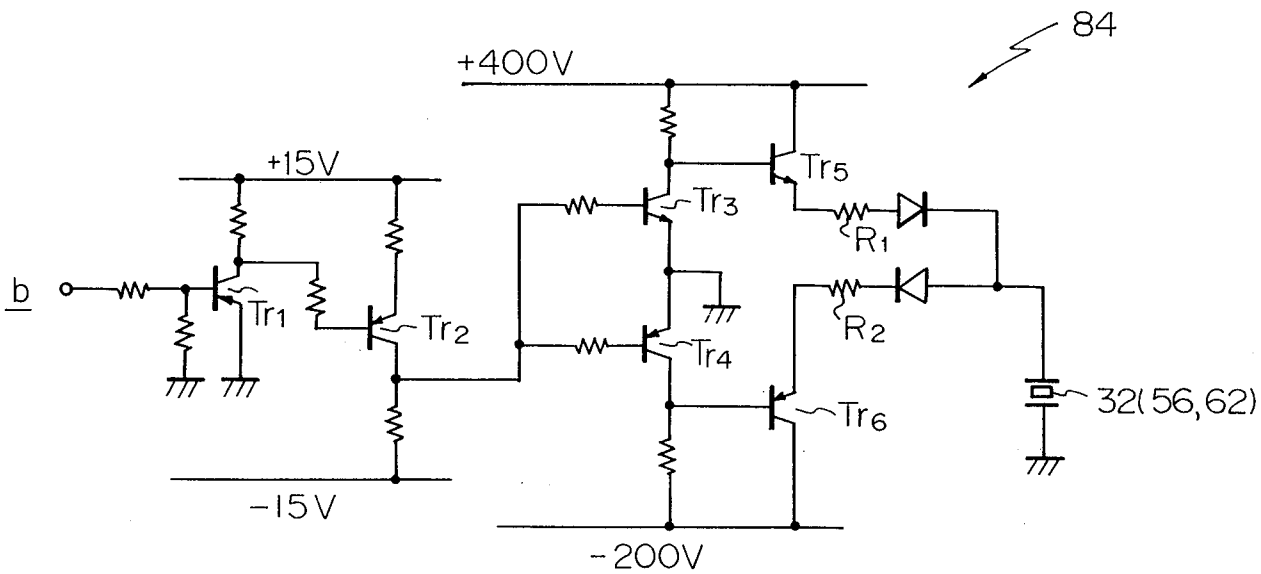
FIG. 9 is a diagram indicative of a practical construction of a time constant generation circuit included in the drive signal generator of FIG. 7.

A practical construction of the time constant generator 84 included in the circuitry of FIG. 7 is shown in FIG. 9. Assume that a 5 V, 50 Hz pulse signal b is converted by a transistor $Tr_1$ into a +15 V pulse which in turn is converted by a transistor $Tr_2$ into a ±10 V pulse. This pulse is amplified by transistors $Tr_3$ and $Tr_4$ into high voltage pulses of +400 V and −400 V respectively, to which a time constant is applied by transistors $Tr_5$ and $Tr_6$ and resistors $R_1$ and $R_2$. Assuming that the capacity of the vibrator 32 is 500 pF and the drive frequency is 50 Hz, the load impedance is 640 KΩ. Then, if the resistance of the resistors $R_1$ and $R_2$ is 500 KΩ, the drive signal will build up and fall with a time constant of 2.5 msec applying voltages of about +200 V and −200 V to the vibrator.

In the manner described, in the cicuitry shown in FIG. 9, the heat loss at the transistors is negligible despite the signal of a high voltage level. This allows the use of transistors having relatively small capacities and, thereby, realizes reliable pumping actions by means of a small-size and economical drive circuit.

In summary, it will be seen that the present invention develops a high delivery pressure for ink due to large displacements of an electrostrictive vibrator, and prevents air bubbles from being formed in the ink by undesirable vacuum in the event of suction because a drive signal applied to the vibrator builds up and falls with a time constant.

While the present invention has been shown and described in relation with ink which is supplied to a head of an ink jet printer, such is only illustrative and the present invention finds application to various other liquids as well.

Various modifications will become possible for those skilled in the art after receiving the teachings of the present disclosure without departing from the scope thereof.

What is claimed is:

1. A pump for pressurizing a liquid to deliver the liquid, comprising:
   - a housing:
   - a liquid chamber formed in said housing;
   - a liquid suction passageway and a liquid delivery passageway which are formed in the housing;
   - suction valve means and delivery valve means disposed respectively in said liquid suction passageway and said liquid delivery passageway;
   - a diaphragm for closing the liquid chamber; and
   - an electrostrictive vibrator rigidly connected to the diaphragm, said electrostrictive vibrator vibrating integrally with the diaphragm perpendicularly to a plane in which the electrostrictive vibrator is connected to the diaphragm, thereby varying a volume of the liquid chamber;
   - said suction valve means comprising a hermatically closed suction chamber formed in a wall of the housing adjacent to the liquid suction passageway, a flexible suction diaphragm defining the suction chamber, a suction electrostrictive vibrator integrally mounted on the outer surface of the suction diaphragm, and a flexible suction member mounted in the suction chamber in position remote from the suction diaphragm and adjacent to the suction passageway.

2. A pump for pressurizing a liquid to deliver the liquid, comprising:
   - a housing:
   - a liquid chamber formed in said housing;
   - a liquid suction passageway and a liquid delivery passageway which are formed in the housing;
   - suction valve means and delivery means disposed respectively in said liquid suction passageway and said liquid delivery passageway;
   - a diaphragm for closing the liquid chamber; and
   - an electrostrictive vibrator rigidly connected to the diaphragm, said electrostrictive vibrator vibrating integrally with the diaphragm perpendicularly to a plane in which the electrostrictive vibrator is connected to the diaphragm, thereby varying a volume of the liquid chamber;
   - said delivery valve means comprising a hermatically closed delivery chamber formed in a wall of the housing adjacent to the liquid delivery passageway, a flexible delivery diaphragm defining the delivery chamber, a delivery electrostrictive vibrator integrally mounted on the outer surface of the delivery diaphragm, and a flexible delivery member mounted in the delivery chamber in position remote from the delivery diaphragm and adjacent to the delivery passageway.

3. A pump for pressurizing a liquid to deliver the liquid, comprising:
   - a housing:
   - a liquid chamber formed in said housing;
   - a liquid suction passageway and a liquid delivery passageway which are formed in the housing;
   - suction valve means and delivery valve means disposed respectively in said liquid suction passageway and said liquid delivery passageway;
   - a flexible diaphragm for closing the liquid chamber;
   - a lid member for cooperating with said diaphragm to define a space at a side opposite to the liquid chamber with respect to the diaphragm; and an electrostrictive vibrator disposed in said space and rigidly connected at one end to the diaphragm and at the other end to an inner wall of the lid member, said electrostrictive vibrator vibrating integrally with the diaphragm perpendicularly to a plane in which the electrostrictive vibrator is connected to the diaphragm, thereby varying a volume of the liquid chamber;

said suction valve means comprising a hermatically closed suction chamber formed in a wall of the housing adjacent to the liquid suction passageway, a flexible suction diaphragm defining the suction chamber, a suction electrostrictive vibrator integrally mounted on the outer surface of the suction diaphragm, and a flexible suction member mounted in the suction chamber in position remote from the suction diaphragm and adjacent to the suction passageway.

4. A pump for pressurizing a liquid to deliver the liquid, comprising:

a housing:

a liquid chamber formed in said housing;

a liquid suction passageway and a liquid delivery passageway which are formed in the housing;

suction valve means and delivery valve means disposed respectively in said liquid suction passageway and said liquid delivery passageway;

a flexible diaphragm for closing the liquid chamber;

a lid member for cooperating with said diaphragm to define a space at a side opposite to the liquid chamber with respect to the diaphragm; and an electrostrictive vibrator disposed in said space and rigidly connected at one end to the diaphragm and at the other end to an inner wall of the lid member, said electrostrictive vibrator vibrating integrally with the diaphragm perpendicularly to a plane in which the electrostrictive vibrator is connected to the diaphragm, thereby varying a volume of the liquid chamber;

said delivery valve means comprising a hermatically closed delivery chamber formed in a wall of the housing adjacent to the liquid delivery passageway, a flexible delivery diaphragm defining the delivery chamber, a delivery electrostrictive vibrator integrally mounted on the outer surface of the delivery diaphragm, and a flexible delivery member mounted in the delivery chamber in position remote from the delivery diaphragm and adjacent to the delivery passageway.

* * * * *